US008813502B2

(12) United States Patent
Ishiguro et al.

(10) Patent No.: US 8,813,502 B2
(45) Date of Patent: Aug. 26, 2014

(54) COOLING STRUCTURE OF GAS TURBINE COMBUSTOR

(75) Inventors: Tatsuo Ishiguro, Hyogo (JP); Katsunori Tanaka, Hyogo (JP); Kotaro Miyauchi, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1093 days.

(21) Appl. No.: 12/598,100

(22) PCT Filed: Sep. 24, 2008

(86) PCT No.: PCT/JP2008/067188

§ 371 (c)(1),
(2), (4) Date: Mar. 2, 2010

(87) PCT Pub. No.: WO2009/041435

PCT Pub. Date: Apr. 2, 2009

(65) Prior Publication Data

US 2010/0180601 A1 Jul. 22, 2010

(30) Foreign Application Priority Data

Sep. 25, 2007 (JP) ..... 2007-247224

(51) Int. Cl.

| | |
|---|---|
| ***F02C 1/08*** | (2006.01) |
| ***F02G 1/055*** | (2006.01) |
| ***F02C 7/12*** | (2006.01) |
| ***F23R 3/28*** | (2006.01) |
| ***F23R 3/00*** | (2006.01) |
| ***F23R 3/06*** | (2006.01) |

(52) U.S. Cl.

CPC ..... *F23R 3/283* (2013.01); *F23R 2900/03044* (2013.01); *F23R 3/005* (2013.01); *F23R 2900/03042* (2013.01); *F23R 3/06* (2013.01)

USPC ..... 60/757; 60/755; 60/756; 60/758; 60/760

(58) Field of Classification Search

USPC ..... 60/752–760, 39.83

See application file for complete search history.

(56) References Cited

U.S. PATENT DOCUMENTS 3,793,827 A * 2/1974 Ekstedt ..... 60/757
4,259,842 A * 4/1981 Koshoffer et al. ..... 60/757

(Continued)

FOREIGN PATENT DOCUMENTS

JP 55-099526 A 7/1980
JP 03-221720 A 9/1991

(Continued)

OTHER PUBLICATIONS

Written Opinion (PCT/ISA/237) for PCT/JP2008/067188, mailing date of Nov. 18, 2008.

(Continued)

*Primary Examiner* — Ehud Gartenberg
*Assistant Examiner* — Karthik Subramanian
(74) *Attorney, Agent, or Firm* — Westerman, Hattori, Daniels & Adrian, LLP

(57) ABSTRACT

It is required for a gas turbine combustor to exhaust low NOx. The gas turbine combustor is provided with a combustion tube which has a cooling passage through which cooling air flows in a double wall structure. The cooling passage has a main cooling air supply opening opened to a side of a combustion zone. The cooling air supplied from the main cooling air supply opening is guided to a direction along an inner wall surface of the combustion tube by a guide. The cooling air flows through the cooling passage inside the combustion tube, and then is reused for film cooling along the inner wall surface. Thus, it is possible to save cooling air. Therefore, a more part of the air supplied from a compressor can be used as air for combustion and it becomes possible to exhaust low NOx.

8 Claims, 9 Drawing Sheets

(56) References Cited

U.S. PATENT DOCUMENTS

| | | | | |
|---|---|---|---|---|
| 4,446,693 | A * | 5/1984 | Pidcock et al. | 60/800 |
| 6,282,905 | B1 * | 9/2001 | Sato et al. | 60/752 |
| 6,543,233 | B2 * | 4/2003 | Young et al. | 60/752 |
| 6,655,146 | B2 * | 12/2003 | Kutter et al. | 60/752 |
| 6,675,582 | B2 * | 1/2004 | Monty et al. | 60/752 |
| 6,761,031 | B2 * | 7/2004 | Bunker | 60/752 |
| 6,810,672 | B2 * | 11/2004 | Coutandin | 60/752 |
| 6,837,050 | B2 * | 1/2005 | Mandai et al. | 60/725 |
| 6,890,148 | B2 * | 5/2005 | Nordlund | 415/115 |
| 7,032,386 | B2 * | 4/2006 | Mandai et al. | 60/757 |
| 7,089,741 | B2 * | 8/2006 | Ikeda et al. | 60/725 |
| 7,089,748 | B2 * | 8/2006 | Tiemann | 60/800 |
| 2001/0027653 | A1 * | 10/2001 | Mandai et al. | 60/757 |
| 2002/0066273 | A1 * | 6/2002 | Kitamura et al. | 60/737 |

FOREIGN PATENT DOCUMENTS

| | | | |
|---|---|---|---|
| JP | 2000-145479 | A | 5/2000 |
| JP | 2002-242702 | A | 8/2002 |
| JP | 2004-044538 | A | 2/2004 |
| JP | 2004-092409 | A | 3/2004 |
| JP | 2005-105817 | A | 4/2005 |
| JP | 2005-315457 | A | 11/2005 |

OTHER PUBLICATIONS

International Search Report of PCT/JP2008/067188, mailing date of Nov. 18, 2008.

Chinese Notice of Grant of Invention Patent dated Nov. 14, 2012, issued in corresponding Chinese Patent Application No. 200880014209.6, (2 pages). With English Translation.

* cited by examiner

COOLING STRUCTURE OF GAS TURBINE COMBUSTOR

TECHNICAL FIELD

The present invention relates to a cooling structure of a gas turbine combustor.

BACKGROUND ART

There is a demand of effective cooling means for a combustor for a gas turbine since the gas turbine combustor arises to a high temperature. In addition, there is another demand of a combustor that can reduce NOx for environment problem.

In Japanese Patent Application Publication (JP-P2005-315457A: first conventional example), a cooling structure of a gas turbine combustor is shown in FIGS. 3 to 6, in particular.

DISCLOSURE OF THE INVENTION

It is an object of the present invention to provide a gas turbine combustor capable of reducing NOx.

It is another object of the present invention to provide a technique suitable to efficiently cool a wall surface of a gas turbine combustor.

A gas turbine combustor according to one aspect of the present invention includes a combustion tube having an inner wall surface facing a combustion zone and an outer wall surface. A plurality of cooling passages are formed between the inner wall surface and the outer wall surface. The plurality of cooling passages includes a plurality of main coolant supply openings on an inner wall side, respectively. The gas turbine combustor further includes a guide guiding coolant supplied from the plurality of main coolant supply openings to a direction along the inner wall surface.

According to one embodiment of the present invention, the guide guides the coolant in a downstream direction from a position of a nozzle supplying fuel toward a tail tube connected to the combustion tube on an axial of the combustion tube.

According to one embodiment of the present invention, the plurality of main coolant supply openings supply the coolant into an inside of the combustion tube in a radial direction.

According to one embodiment of the present invention, the plurality of main coolant supply openings are provided on downstream ends of the plurality of cooling passages in a flow direction of the coolant, respectively.

According to one embodiment of the present invention, the gas turbine combustor further includes a plurality of auxiliary coolant supply openings supplying the coolant in a region outside of the outer wall surface into a gap formed between the inner wall surface and the guide. The coolant supplied from the plurality of auxiliary coolant supply openings is guided to the direction along the inner wall surface by the guide. The plurality of main coolant supply openings and the plurality of auxiliary coolant supply openings are formed in positions shifted from one another in a flow direction of the coolant guided by the guide.

The gas turbine combustor according to one embodiment of the present invention further includes a spacer preventing the gap from narrowing. The spacer is arranged downstream of the plurality of auxiliary coolant supply openings in the flow direction of the coolant supplied from the plurality of auxiliary coolant supply openings. The plurality of main coolant supply ports are arranged downstream of the spacer.

The gas turbine combustor according to one embodiment of the present invention further includes a spacer preventing the gap from narrowing. The spacer is arranged downstream of the plurality of main coolant supply openings in the flow direction of the coolant supplied from the plurality of main coolant supply openings. The plurality of auxiliary coolant supply openings are arranged downstream of the spacer.

The gas turbine combustor according to one embodiment of the present invention further includes a cavity to which the plurality of auxiliary coolant supply openings are opened. The coolant supplied from the coolant supply openings is supplied to the gap via the cavity. A flow rate of the coolant in the cavity is lower than a flow rate of the coolant in the gap.

According to one embodiment of the present invention, the combustion tube includes a bulge section. The bulge section is arranged upstream of a predetermined position set upstream of the plurality of main coolant supply openings in a main flow direction of the fuel in the combustion zone, and projects into the side opposite to the combustion region. The guide is substantially flat in the main flow direction near the predetermined position. The cavity is formed in a region between the inner wall surface and the guide in the bulge section. The gap is formed by a region between the inner wall surface downstream of the predetermined position in the main flow direction and the guide.

The present invention provides the gas turbine combustor capable of reducing NOx. Furthermore, the present invention provides technique adapted to efficiently cool a tube wall of a gas turbine combustor.

BEST MODE FOR CARRYING OUT THE INVENTION

Hereinafter, embodiments of the present invention will be described with reference to the attached drawings.

First Embodiment

Figure 1:
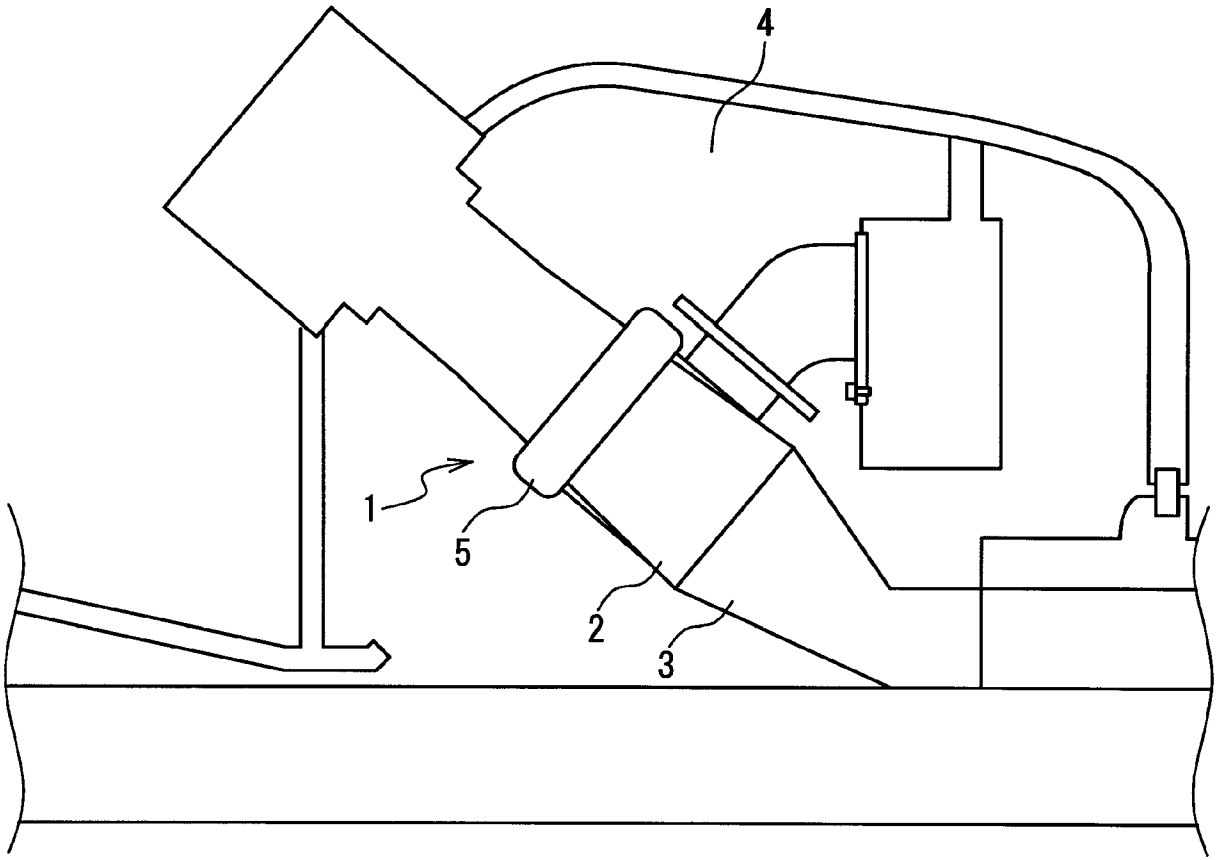
FIG. 1 shows a gas turbine combustor.

FIG. 1 shows a combustor 1 of a gas turbine. The combustor 1 is disposed within a wheel chamber 4 defined by a wheel chamber wall. The combustor 1 includes a combustor tube 2 in which a combustion zone is formed and a tail tube 3 connected to a downstream side (a side closer to the turbine) of the combustion tube 2.

Figure 2:
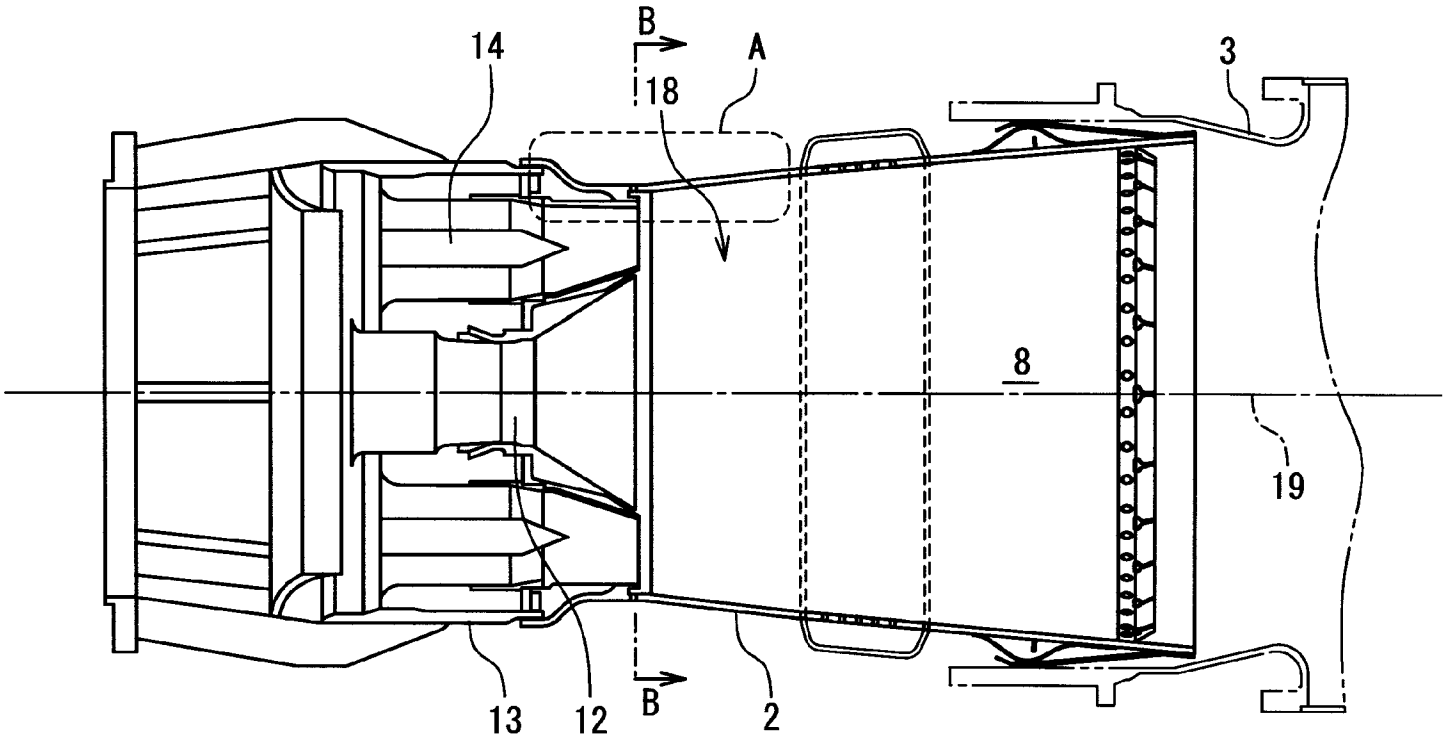
FIG. 2 is a cross sectional side view showing a combustion tube and neighborhoods of the combustion tube.
Figure 3A:
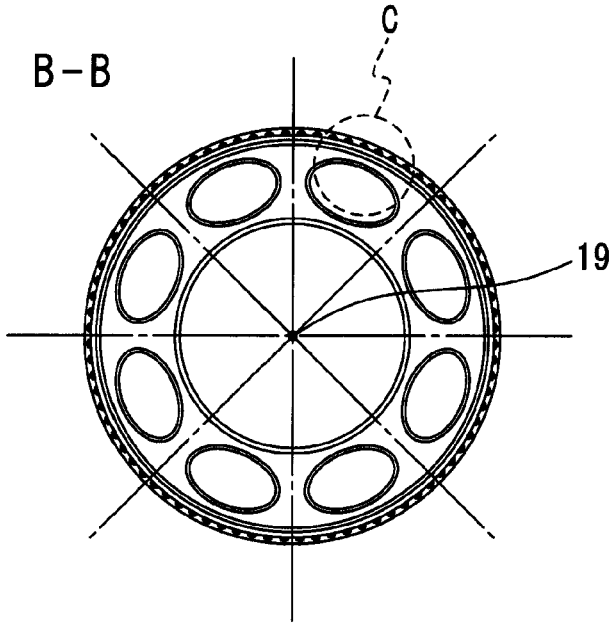
FIG. 3A is a cross sectional view showing the combustion tube and neighborhoods of the combustion tube in a direction perpendicular to a central axis.
Figure 3B:
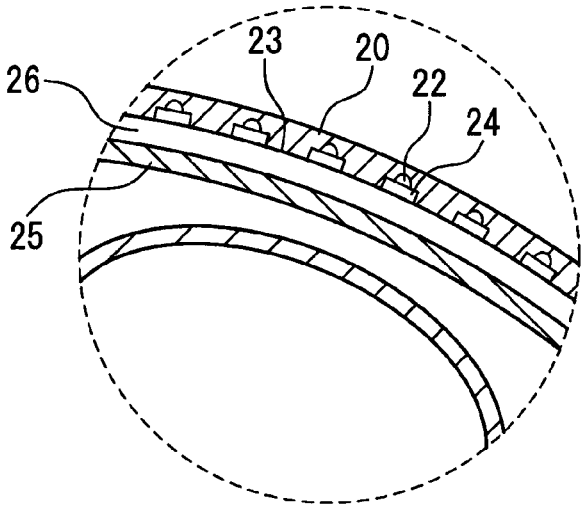
FIG. 3B is a partially enlarged view of FIG. 3A.

FIG. 2 is a cross sectional view of the combustor 1 in neighborhood of the combustion tube 2. An inner space of the combustion tube 2 is a combustion zone 8. A pilot nozzle 12 is provided on a central axis of a substantially cylindrical nozzle holding tube 13 (which axis coincides with a central axis 19 extending in a direction connecting an upstream side to a downstream side of the combustion tube 2) on the upstream side of the combustion tube 2. A plurality of main nozzles 14 are provided to surround the pilot nozzle 12 on a circle having a predetermined radius from the central axis 19. FIG. 3A shows a B-B cross section of FIG. 2 and FIG. 4A to be described later. FIG. 3B is an enlarged view showing a wall surface of the combustion tube 2 and neighborhood of the wall surface.

Figure 4A:
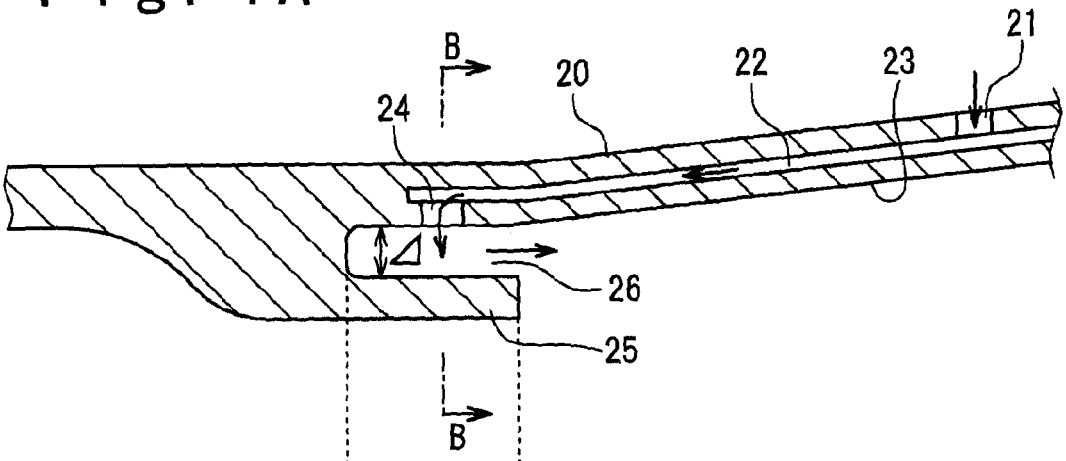
FIGS. 4A and 4B are a cross sectional view and a top view, respectively showing a wall surface near a location at which the main nozzle is disposed.
Figure 4B:
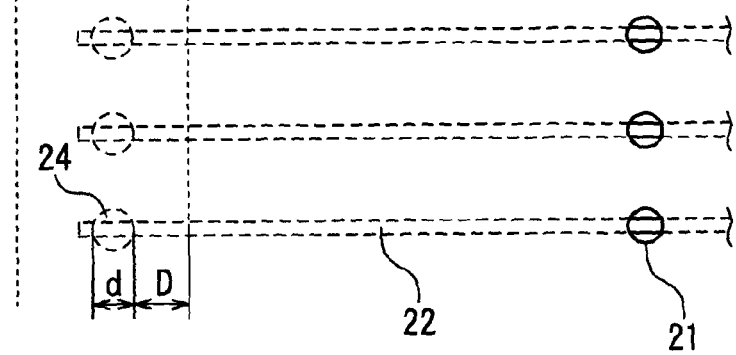

FIGS. 4A and 4B show the wall surface of the combustion tube 2 near a portion in which each of the main nozzles 14 is provided. FIG. 4A is a cross sectional view. A plurality of cooling passages 22 through which the air acting as coolant passes are provided between an inner wall surface 23 facing the combustion zone 8 and an external wall surface 20 facing the wheel chamber. That is, the wall surface has a double-wall structure in which the cooling passages 22 are provided. FIG. 4B is a top view showing arrangement of the cooling passages 22 from a viewpoint in a direction perpendicular to the wall surface. The plurality of cooling passages 22 is arranged to extend in a direction parallel to a main flow direction of combustion gas of the combustor, that is, a direction almost parallel to the central axis 19. Each of the cooling passages 22 is connected to a coolant inlet opening 21 that is open to the wheel chamber 4 at a predetermined position. One end of each of the plurality of cooling passages 22 is open to a coolant supply opening 24 provided in the inner wall surface 23. The coolant supply opening 24 is also referred to as a "main coolant supply opening" when being compared with an auxiliary coolant supply port to be described later. The coolant supply opening 24 is positioned upstream of the coolant inlet opening 21 in the main flow direction of the combustion gas and is closer to the main nozzle 14. From another standpoint, since the flow of the coolant in each cooling passage 22 is in a direction from the coolant inlet opening 21 to the coolant supply opening 24, the coolant supply opening 24 is open to a gap 26 near a downstream end of the flow of the coolant in each cooling passage 22.

The side of the combustion zone 8 of the coolant supply opening 24 is covered with a guide 25 via the gap 26. The guide 25 is a member fixed to the wall surface of the combustion tube 2. As shown in FIG. 3B, the guide 25 is arranged along the interior of the outer wall surface 20 having the central axis 19 as a center (typically, on a circle around the central axis 19). The guide 25 closes an upstream side of the gap 26. A downstream side of the gap 26 is open and communicates with the combustion zone 8 at a position near the inner wall surface 23. This guide 25 is provided to introduce the coolant downstream. More specifically, with respect to the central axis of the combustion tube 2 which is almost rotation symmetry, the guide 25 introduces the coolant downstream in the axial direction from a position at which nozzles for supplying the fuel are provided to the tail tube.

The height of the gap 26 between the guide 25 and the inner wall surface 23 is assumed as Δ. The coolant supply opening 24 is assumed to be a circle having a diameter d. A length from a downstream end of the coolant supply opening 24 to a downstream end of the guide 25 in a direction parallel to the central axis 19 is assumed as D. It is preferable to satisfy $\Delta<d$ and $D>d$ in order to form good film air.

During operation of the gas turbine, a compressor supplies compressed air to the wheel chamber 4. A part of the compressed air is supplied for combustion of the fuel in the combustion zone 8. The other part of the compressed air is introduced from the coolant inlet openings 21 into the cooling passages 22 by using a pressure difference. A temperature of a combustion wall is high since the combustion tube wall is in contact with the combustion zone 8. By making the air to flow through the cooling passages 22 as coolant, the combustion wall is cooled. The air passing through the cooling passages 22 is supplied from the coolant supply openings 24 to the gap 26. A flow direction of the air in each coolant supply opening 24 is a radially inward direction of a cross section perpendicular to a central axis of a cylindrical shape around the central axis 19. The guide 25 introduces the air supplied to the gap 26 in a direction along the inner wall surface 23. The inner wall surface 23 is subjected to film cooling by this air.

By this configuration, the air passing through the cooling passages 22 and used to cool the interior of the tube wall is collected and also used for the film cooling. By efficiently using the air for cooling ("cooling air"), the cooling air can be saved and the air resulting from the saving of the cooling air can be used as the air for combustion ("combustion air"). Through increase in the combustion air, NOx generation can be suppressed.

It is necessary to secure the film air of a predetermined flow rate in order to prevent flashback from occurring in the combustor 1 during gas firing using the gas as the fuel of the combustor 1 or to prevent oil fuel used during oil firing using oil as the fuel from remaining on the wall surface. If the air necessary for the film cooling is more than minimal cooling air necessary for cooling the tube wall by the cooling passages 22, more cooling air than the minimal air can flow through the cooling passages 22 and reliability of the combustor can be further improved. Even in this case, the combustion air does not decrease.

Moreover, in the process of using the air for cooling the tube wall, the temperature of the air rises and density thereof decreases. Due to this, as compared with direct supply of the air in a same amount from the wheel chamber, the flow rate of the film air is high and a dynamic pressure of the film can be increased, even if an area of each coolant supply opening 24 for the film cooling is the same. If the dynamic pressure of the film air is high, it is particularly possible to prevent the oil from remaining on the inner wall surface 23.

A cooling structure of the coolant inlet openings 21, the cooling passages 22, the coolant supply openings 24 and the guide 25 shown in FIGS. 4A and 4B is effective even if the cooling structure is provided for any tube wall of the combustion tube. In particular, a temperature of the wall surface of a region close to the main nozzles is high. Therefore, it is effective to provide the cooling structure in a position close to the main nozzles, that is, a position close to an upstream end of the combustion zone 8.

Second Embodiment

Figure 5A:
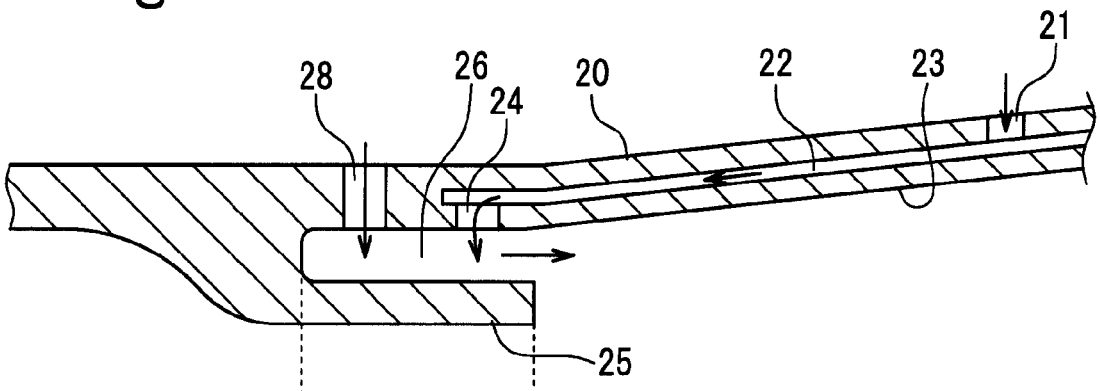
FIGS. 5A and 5B are a cross sectional view and a top view, respectively showing a wall surface near a location at which the main nozzle is disposed.
Figure 5B:
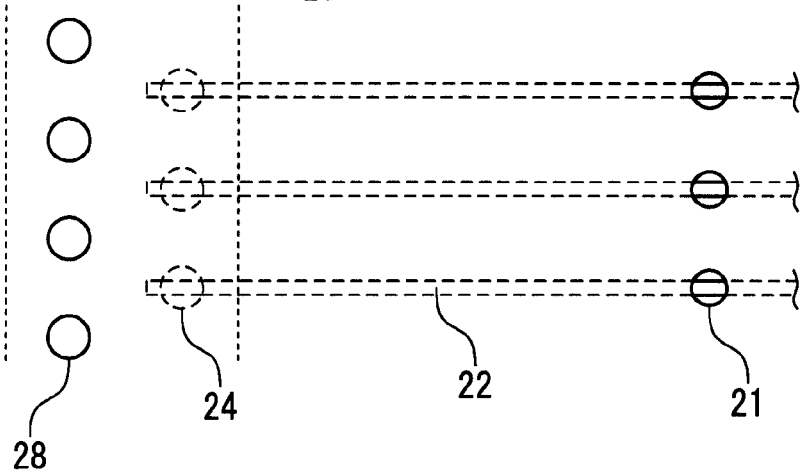

The gas turbine combustor according to a second embodiment of the present invention differs from that of the first embodiment in a configuration of a wall surface near a location of the combustion tube 2 in which the main nozzles 14 are provided. FIGS. 5A and 5B show the configuration. FIG. 5A is a cross sectional view. The cooling structure according to the present embodiment includes auxiliary coolant supply openings 28 in addition to the coolant inlet openings 21, the cooling passages 22, the coolant supply openings 24 and the guide 25 similarly to the first embodiment. The auxiliary coolant supply openings 28 directly supply the compressed air in the wheel chamber 4 to the gap 26 formed by the guide 25.

FIG. 5B is a top view showing an arrangement of the cooling passages 22 in a direction perpendicular to the wall surface. The auxiliary coolant supply openings 28 are open to the gap 26 upstream of the coolant supply openings 24. The coolant supply openings 24 and the auxiliary coolant supply openings 28 are arranged in positions shifted from one another by a half-pitch in a circumferential direction perpendicular to a main flow direction of cooling air, that is, in a direction parallel to the central axis 19 and perpendicular to a direction from an upstream side on which the main nozzles 14 and the pilot nozzle 12 are provided to a downstream side on which the tail tube 3 is connected (or a flow direction of coolant guided by the guide 25). In an example of FIG. 5B, the coolant supply openings 24 and the auxiliary coolant supply openings 28 are alternately arranged in the circumferential direction of the combustion tube.

During driving of a gas turbine, the compressed air of the wheel chamber is introduced into the combustion tube 2 via the coolant inlet openings 21, the cooling passages 22 and the coolant supply openings 24. The guide 25 supplies the compressed air into a region along the inner wall surface 23 on the downstream side. A film formed by this air has a spotted distribution resulting from a pitch of the cooling passages 22. Each of the auxiliary coolant supply openings 28 supplies auxiliary film air into a region in which a density of the film air supplied from each coolant supply opening 24 is low and can make flow rate variation uniform at an outlet of the film. Since the uniform film can be formed, it is possible to realize a high film efficiency and prevent flashback and residence of oil.

Such a configuration is particularly suited in a case that an amount of the cooling air collected as the film air from the cooling passages 22 is smaller than an amount necessary as the film air. The air added as the film is air necessary for the film and the air in an excessive amount is unnecessary. Since a part of the film air is the air recycled after collecting the air used for cooling a combustor wall, the cooling air can be saved. Thus, it is possible to secure the combustion air and reduce NOx.

Figure 6A:
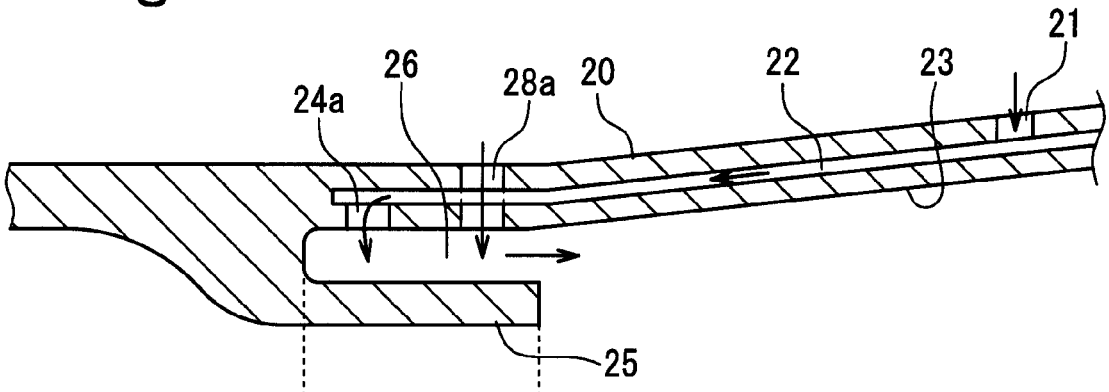
FIGS. 6A and 6B are a cross sectional view and a top view, respectively showing a wall surface near a location at which the main nozzle is disposed.
Figure 6B:
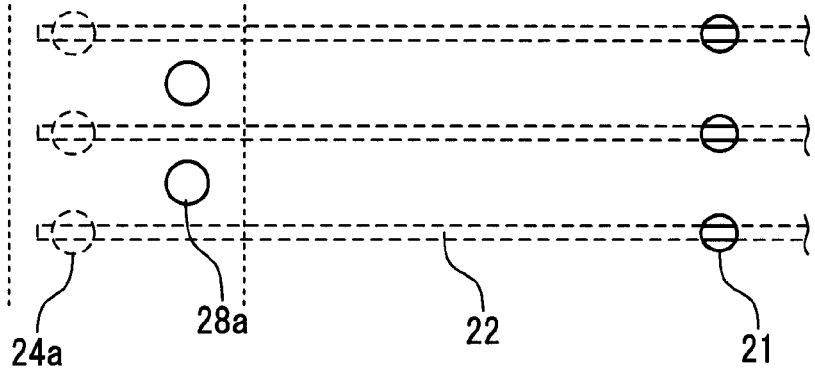

FIGS. 6A and 6B show a modification of the second embodiment. This modification differs from FIGS. 5A and 5B in that auxiliary coolant supply openings 28*a* are provided downstream of coolant supply openings 24*a*. Even if the gas turbine combustor is configured as shown in FIGS. 6A and 6B, the same advantages as those of the second embodiment can be obtained.

Third Embodiment

Figure 7A:
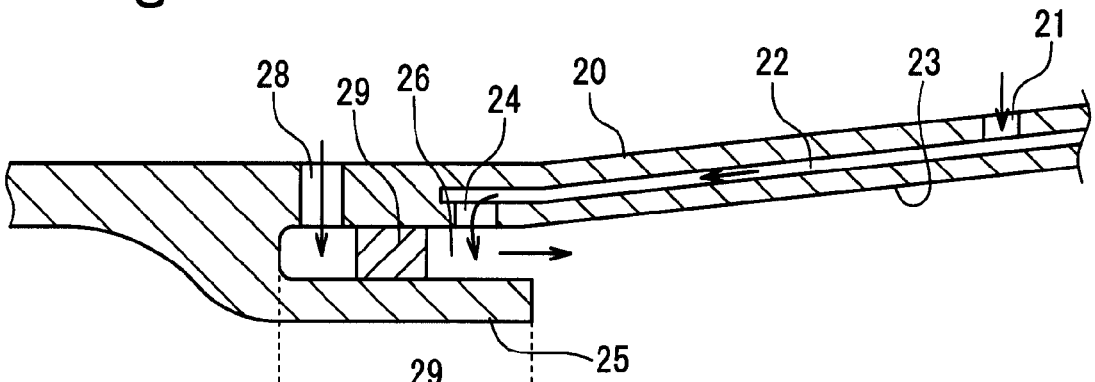
FIGS. 7A and 7B are a cross sectional view and a top view, respectively showing a wall surface near a location at which the main nozzle is disposed.
Figure 7B:
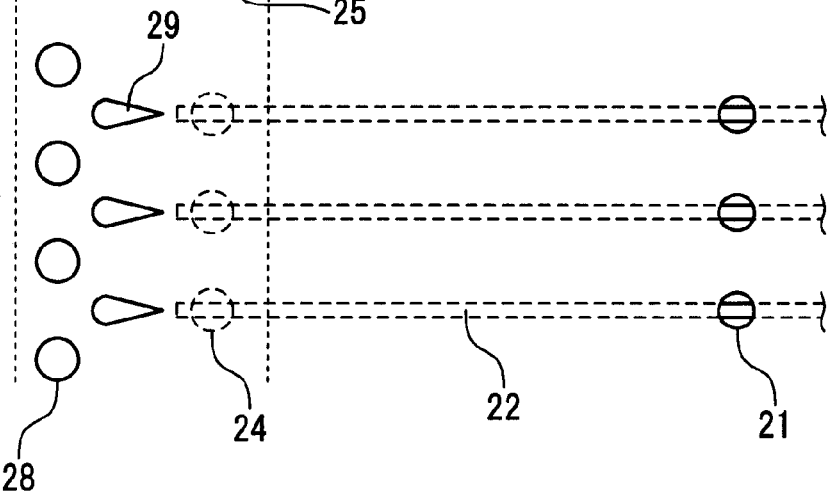

The gas turbine combustor according to a third embodiment of the present invention differs from that of the second embodiment in a configuration that a spacer member is provided between a wall surface of the combustion tube 2 and the guide 25. FIGS. 7A and 7B show the configuration. FIG. 7A is a cross sectional view. FIG. 7B is a top view. A spacer 29 is provided between the guide 25 and the inner wall surface 23 opposed to the guide 25. Each spacer 29 shown in FIG. 7B has a teardrop cross section having a head upstream and a tail downstream. The spacers 29 keep the guide 25 to have a predetermined distance to the inner wall surface 23.

The coolant supply openings 24 are arranged downstream of the respective spacers 29. The auxiliary coolant supply openings 28 are arranged upstream of the respective spacers 29. "Upstream" and "downstream" are defined herein according to a main flow direction of coolant supplied from the auxiliary coolant supply openings 28 in the gap 26. The spacers 29 and the coolant supply openings 24 are arranged at positions staggered from the auxiliary coolant supply openings 28 by a half-pitch in a direction perpendicular to a flow direction of cooling air supplied from the auxiliary coolant supply openings 28.

During operation of the gas turbine, the spacers 29 keep a slot height of a gap 25 constant. The compressed air of the wheel chamber is supplied to the gap 26 from the auxiliary coolant supply openings 28. The guide 25 introduces the supplied air into a region along the inner wall surface 23. Auxiliary film air formed by the auxiliary coolant supply openings 28 has a low flow rate on a downstream side of the spacers 29. Film air formed by the air supplied from the coolant supply openings 24 and direction-changed by the guide 25 is supplied to a region downstream of the spacers 29. By this configuration, uniform film air can be formed even if the spacers 29 keeping a slot height of the gap 26 constant are provided.

Figure 8A:
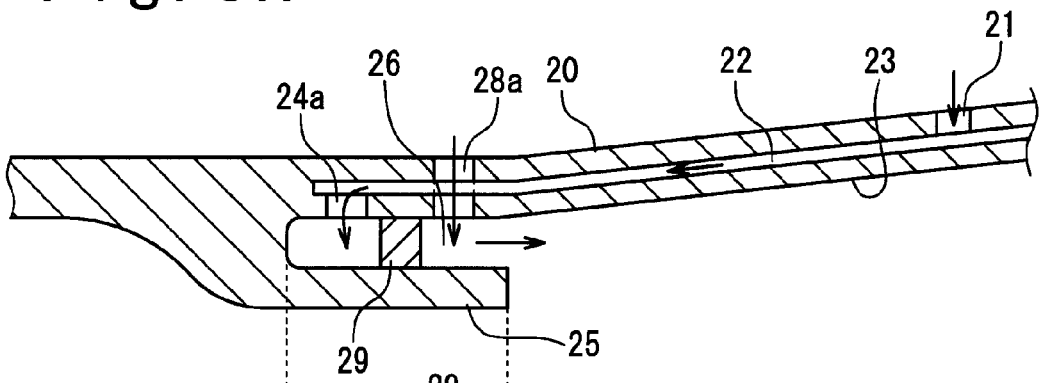
FIGS. 8A and 8B are a cross sectional view and a top view, respectively showing a wall surface near a location at which the main nozzle is disposed.
Figure 8B:
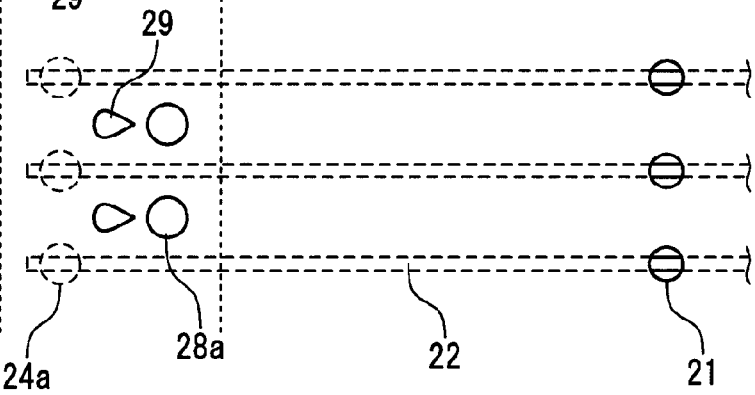

In a modification of the third embodiment, the same advantages can be obtained by arranging the coolant supply openings 24 and the auxiliary coolant supply openings 28 at opposite positions to those according to the third embodiment. The gas turbine combustor according to the modification of the third embodiment is configured so that the spacers 29 are arranged between the coolant supply openings 24*a* and the auxiliary coolant supply openings 28*a* shown in FIGS. 6A and 6B. FIG. 8A is a cross sectional view of the gas turbine combustor and FIG. 8B is a top view thereof. In this modification, the spacers 29 are arranged at positions staggered by a half-pitch from the coolant supply openings 24*a* formed upstream of the spacers 29 in a direction perpendicular to a flow direction of the air to be introduced from the coolant supply openings 24*a* to be introduced downstream by the guide 25.

It is preferable to arrange the spacers 29 at positions close to a downstream end of the gap 26 so that the spacers 29 can keep a slot height of the gap 26 constant. Thus, the gas turbine combustor is preferably configured so that either the auxiliary coolant supply openings 28 (corresponding to the third embodiment) or the coolant supply openings 24*a* (corresponding to the modification of the third embodiment) are arranged upstream of the spacers 29.

Fourth Embodiment

Figure 9:
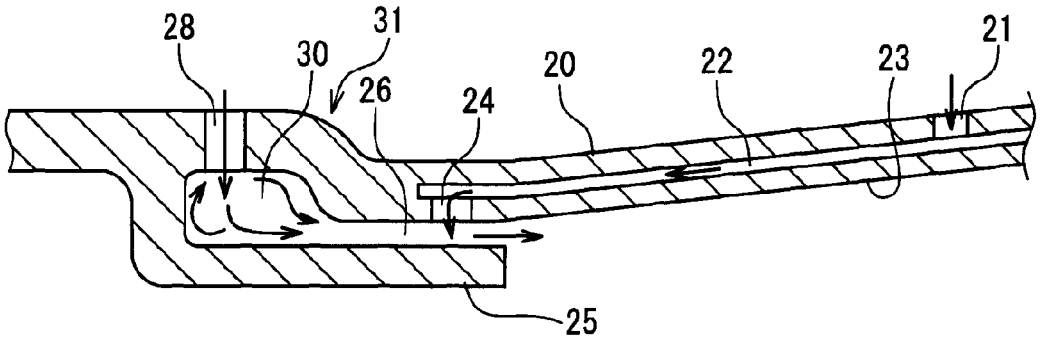
FIG. 9 is a cross sectional view showing a wall surface near a location at which the main nozzle is disposed.

The gas turbine combustor according to a fourth embodiment of the present invention differs from that of the second embodiment in that the gas turbine combustor includes a cavity for reducing a flow rate of auxiliary coolant directly supplied from the wheel chamber. FIG. 9 is a cross sectional view of the gas turbine configured as stated above. A tube wall of the combustion tube 2 includes a bulge section 31. The bulge section 31 is formed upstream of a predetermined position in a main flow direction of cooling air or fuel. In the bulge section 31, the combustion tube 2 projects to an opposite side to the combustion zone 8, that is, projects to the wheel chamber 4. The guide 25 is substantially flat in the main flow direction near the predetermined position, that is, both upstream and downstream of the predetermined position. A region between the inner wall surface 23 and the guide 25 in the projecting region forms a cavity 30. A cross sectional area of the cavity 30 perpendicular to the flow direction in the gap 26 is larger than that of the gap 26.

Both of the air supplied from the coolant supply openings 24 and the air supplied from the auxiliary coolant supply openings 28 are supplied by using a pressure difference between the wheel chamber 4 and the combustion zone 8. A flow rate of the air supplied from the coolant supply openings 24 is low since the air passes through the cooling passages 22. On the other hand, a flow rate of the air supplied from the auxiliary coolant supply openings 28 is high since the air is directly supplied from the wheel chamber 4. As a result, the air supplied as a film has a flow rate variation. By providing the cavity 30, it is possible to reduce the flow rate of the air supplied from the auxiliary coolant supply openings 28 and form a uniform film air.

Figure 10:
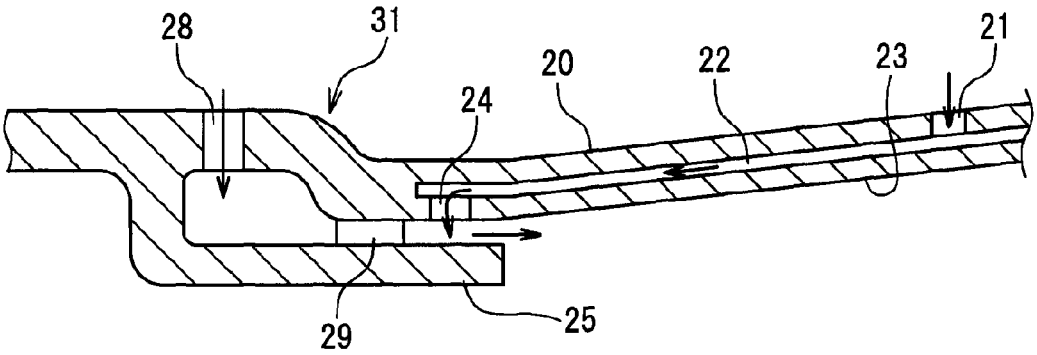
FIG. 10 is a cross sectional view showing a wall surface near a location at which the main nozzle is disposed.

FIG. 10 shows a modification of the fourth embodiment. The spacers 29 similar to those according to the third embodiment are provided between a wall surface of the combustion tube 2 and the guide 25. Each spacer 29 is provided in a region downstream of the cavity 30, in which the gap 26 is narrow and which is upstream of the coolant supply openings 24. The spacers 29 are provided at positions staggered by a half-pitch from the coolant supply openings 24 in a direction perpendicular to a flow of cooling air.

This application is based upon Japanese Patent Application No. 2007-247224 filed on Sep. 25, 2007. The disclosure thereof is incorporated herein by reference.

The invention claimed is:

1. A gas turbine combustor comprising:

a combustion tube which has an inner wall surface facing a combustion zone and an outer wall surface of the combustion tube;

wherein a plurality of cooling passages are formed between the inner wall surface and the outer wall surface, said plurality of cooling passages having a plurality of main coolant supply openings on said inner wall surface;

a guide configured to guide coolant supplied from said plurality of main coolant supply openings into a direction along said inner wall surface;

a plurality of auxiliary coolant supply openings configured to supply said coolant in a region outside said outer wall surface to a gap between said inner wall surface and said guide;

wherein said coolant, which is introduced from said plurality of auxiliary coolant supply openings, is guided to the direction along said inner wall surface by said guide, said plurality of main coolant supply openings and said plurality of auxiliary coolant supply openings are formed at positions so that the positions of the main coolant supply openings and the auxiliary coolant supply openings are shifted with respect to each other by a predetermined distance in the direction of flow of said coolant guided by said guide, and relations $\Delta<d$ and $D>d$ are satisfied where a height of the gap between said guide and the inner wall surface is $\Delta$, the coolant supply opening is a circle having a diameter d, and a length from a downstream end of the coolant supply opening to a downstream end of the guide in a direction parallel to the central axis is D.

2. The gas turbine combustor according to claim 1, wherein said guide introduces the coolant downstream in an axial direction that extends from a position where a nozzle is provided to supply a fuel towards a position where the tail tube is connected with said combustion tube on an axis of said combustion tube.

3. The gas turbine combustor according to claim 2, wherein said plurality of main coolant supply openings supply said coolant toward an inside of said combustion tube in a radial direction.

4. The gas turbine combustor according to claim 1, wherein said plurality of main coolant supply openings are provided towards downstream ends of said plurality of cooling passages through which said coolant flows.

5. The gas turbine combustor according to claim 1, further comprising:

spacers configured to keep said gap at a predetermined width, wherein said spacers are arranged downstream of said plurality of auxiliary coolant supply openings in a direction of flow of said coolant which is supplied from said plurality of auxiliary coolant supply openings, and said plurality of main coolant supply openings are arranged downstream of said spacers.

6. The gas turbine combustor according to claim 1, further comprising:

spacers configured to keep said gap at a predetermined width, wherein said spacers are arranged downstream of said plurality of main coolant supply openings in a direction of flow of said coolant which is supplied from said plurality of main coolant supply openings, and said plurality of auxiliary coolant supply openings are arranged downstream of said spacers.

7. The gas turbine combustor according to claim 1, further comprising:

a cavity to which said plurality of auxiliary coolant supply openings are opened, wherein said coolant supplied from said auxiliary coolant supply openings is supplied to said gap through said cavity, and a flow rate of said coolant in said cavity is slower than a flow rate of said coolant in said gap.

8. The gas turbine combustor according to claim 7, wherein said combustion tube having a bulge section, said bulge section is provided upstream of a predetermined position, which is upstream of said plurality of main coolant supply openings in a direction of a main flow of fuel in the combustion zone, said bulge section extending in a direction opposite to the combustion zone, said guide is substantially flat in the main flow direction near the predetermined position, said cavity is formed in a region between said inner wall surface and said guide in said bulge section, and said gap is formed in a region between said inner wall surface and said guide downstream of the predetermined position in the main flow direction.

* * * * *